US005692401A

United States Patent [19]

Khalsa

[11] Patent Number: 5,692,401

[45] Date of Patent: Dec. 2, 1997

[54] INTEGRAL BOX CAR LOCK

[76] Inventor: Ekongkar S. Khalsa, Rte. 1, Box 219, Espanola, N. Mex. 87532

[21] Appl. No.: 582,531

[22] Filed: Jan. 11, 1996

[51] Int. Cl.[6] ..... E05B 65/08; G05G 5/00

[52] U.S. Cl. ..... 70/95; 70/203; 70/224; 292/DIG. 32; 49/449

[58] Field of Search ..... 70/201–203, 210–212, 70/224, 95; 292/DIG. 32, DIG. 46; 16/363, 351, 350; 49/449

[56] References Cited

U.S. PATENT DOCUMENTS

| | | | |
|---|---|---|---|
| 230,239 | 6/1880 | Germond . | |
| 357,344 | 2/1887 | Smith | 16/351 |
| 613,013 | 10/1898 | Ligthiser | 292/DIG. 32 |
| 667,851 | 2/1901 | Roscow | 16/351 |
| 1,004,758 | 10/1911 | Ebbert . | |
| 1,117,510 | 11/1914 | Malone . | |
| 1,185,618 | 6/1916 | Blanchard . | |
| 1,197,937 | 9/1916 | Jackson | 70/212 |
| 1,244,404 | 10/1917 | Ankovitz . | |
| 1,291,291 | 1/1919 | Vesely | 70/212 |
| 1,328,109 | 1/1920 | Witlock . | |
| 1,377,224 | 5/1921 | Strosnider . | |
| 1,505,192 | 8/1924 | Gervais, Jr. | 16/351 |
| 1,508,013 | 9/1924 | DeWaters | 16/351 |
| 1,850,602 | 3/1932 | Pineo . | |
| 1,959,664 | 5/1934 | Fuqua et al. | 16/351 |
| 2,716,882 | 9/1955 | Gill et al. . | |
| 2,997,752 | 3/1961 | Henrikson et al. | 20/23 |
| 3,869,162 | 3/1975 | Schuller | 292/DIG. 32 |
| 4,014,572 | 3/1977 | Binns | 292/DIG. 32 |
| 4,565,296 | 1/1986 | Kochakis | 70/56 |
| 4,640,109 | 2/1987 | Schaublin et al. | 70/202 |
| 4,852,920 | 8/1989 | DeForrest, Sr. | 292/205 |
| 4,895,007 | 1/1990 | Eberly | 70/54 |
| 4,898,008 | 2/1990 | Eberly | 70/56 |
| 5,036,684 | 8/1991 | Zivanovic | 70/161 |
| 5,054,723 | 10/1991 | Arnold | 16/350 |
| 5,174,135 | 12/1992 | Loughlin | 70/2 |

*Primary Examiner*—Darnell M. Boucher
*Attorney, Agent, or Firm*—August E. Roehrig, Jr.

[57] ABSTRACT

A freight car door securing device which is incorporated into the structure of the freight car door to prevent the rotatable door handle, the rotation of which latches and unlatches the car door in a closed or locked position, from being rotated. The securing device is movable from a position wherein it is out of interference with the movement of the rotatable handle, thereby permitting the door to be opened, to a position in which it is fixed to prevent the handle from rotating, thereby preventing the handle from being operated to open the door.

10 Claims, 8 Drawing Sheets

INTEGRAL BOX CAR LOCK

BACKGROUND OF THE INVENTION

This invention relates in general to locking devices and, in particular, to a locking device which is constructed to be a part of the loading door of a railroad freight car. More specifically, but without restriction to the particular use which is shown and described, this invention relates to a locking device which is secured to the sliding loading door of a railroad freight car for maintaining the door in a locked position, but which is actuable to release the door opening mechanism for opening the door when desired.

As is known to those in the railroad industry, one type of access or loading door frequently used on railroad freight cars and through which the contents of the freight car are loaded and removed, is carried by the freight car so that the door will slide parallel to the sides of the car permitting an unobstructed access for loading and unloading. These sliding doors are latched in a closed position by rotation of an opening handle operating through a gear box secured to the door of the freight car. Rotational movement of the handle, through operation of a gear train, releases a latching mechanism permitting the freight car door to be slid out from a closed position for loading or unloading.

Because freight cars are generally unattended and frequently are stored in and move through unpopulated areas, pilferage of the contents can occur if the loading doors are not locked against unauthorized entry. It is, therefore, desirable that a locking device be provided which will be rugged enough to withstand the working environment associated with freight cars, and the loading and unloading thereof, while functioning as a deterrent against the unauthorized entry into the freight car. It is also a desirable feature that such a lock be securable in a fixed position, when not securing the freight car door, so that it does not engage accidentally or become a hazard to other operations.

SUMMARY OF THE INVENTION

It is, therefore, an object of this invention to improve the construction of railroad freight car doors by incorporating a securing device into the door structure.

Another object of this invention is to facilitate securing a railroad freight car against the unauthorized entry thereinto.

A further object of this invention is to secure the rotatable handle of a freight car opening mechanism, through which access is gained to the interior of the car, in a fixed position to prevent the movement thereof thereby preventing the unauthorized opening of the freight car loading door.

These and other objects are attained in accordance with the present invention wherein there is provided a freight car door securing device which is incorporated into the structure of the freight car door to prevent the rotatable door handle, the rotation of which latches and unlatches the car door in a closed or locked position, from being rotated. The securing device is movable from a position wherein it is out of interference with the movement of the rotatable handle, thereby permitting the door to be opened, to a position in which it is fixed to prevent the handle from rotating, thereby preventing the handle from being operated to open the door.

BRIEF DESCRIPTION OF THE DRAWING

Further objects of the invention, together with additional features contributing thereto and advantages accruing therefrom, will be apparent from the following description of a preferred embodiment of the invention which is shown in the accompanying drawings with like reference numerals indicating corresponding parts throughout, wherein.

DESCRIPTION OF THE PREFERRED EMBODIMENT

Figure 1:
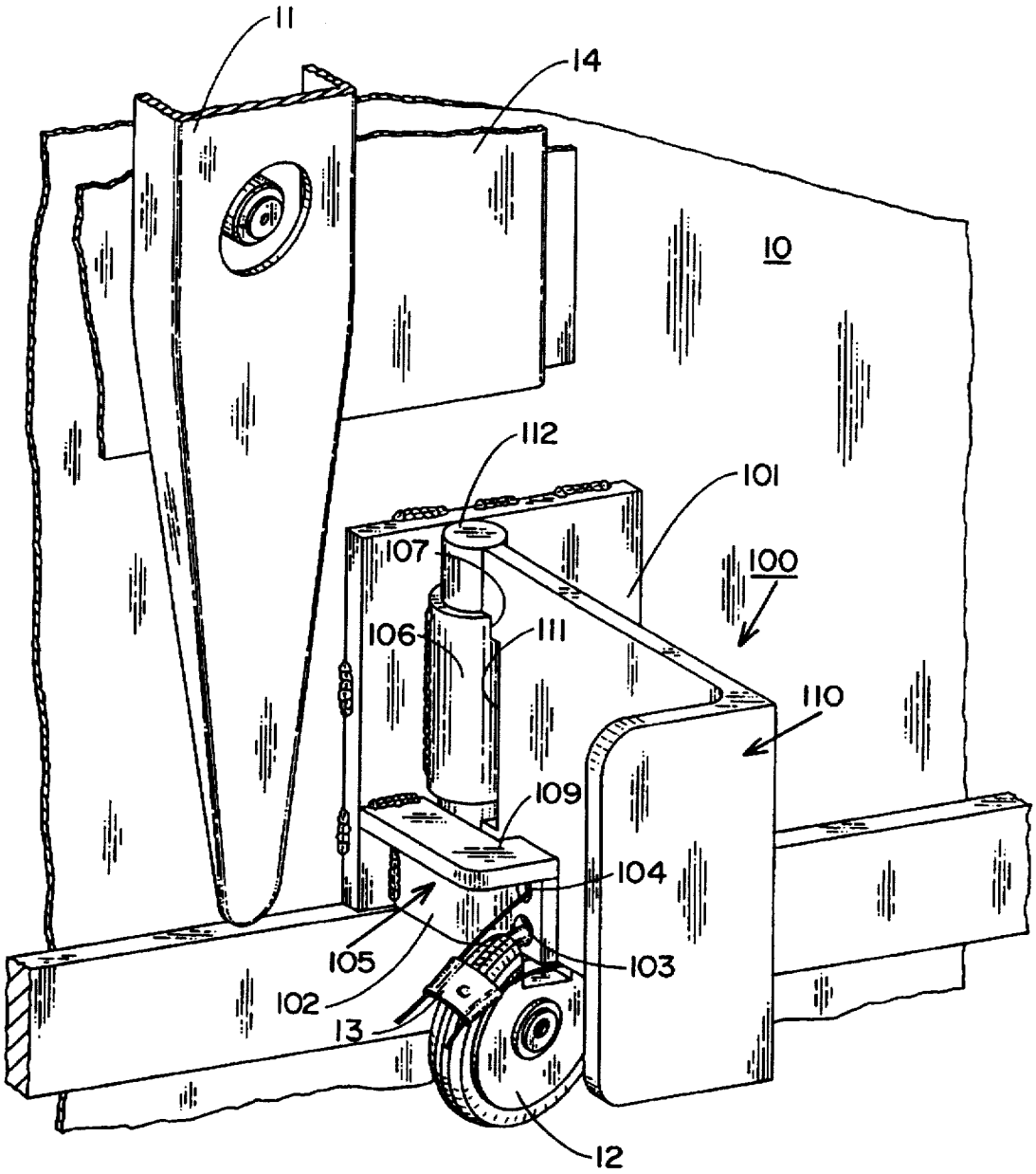
FIG. 1 is a perspective view of the locking device of this invention incorporated into the structure of a freight car loading door and locked in a position to prevent rotation of the door handle, the operation of which controls movement of the loading door and, thereby, entry into the freight car.
Figure 2:
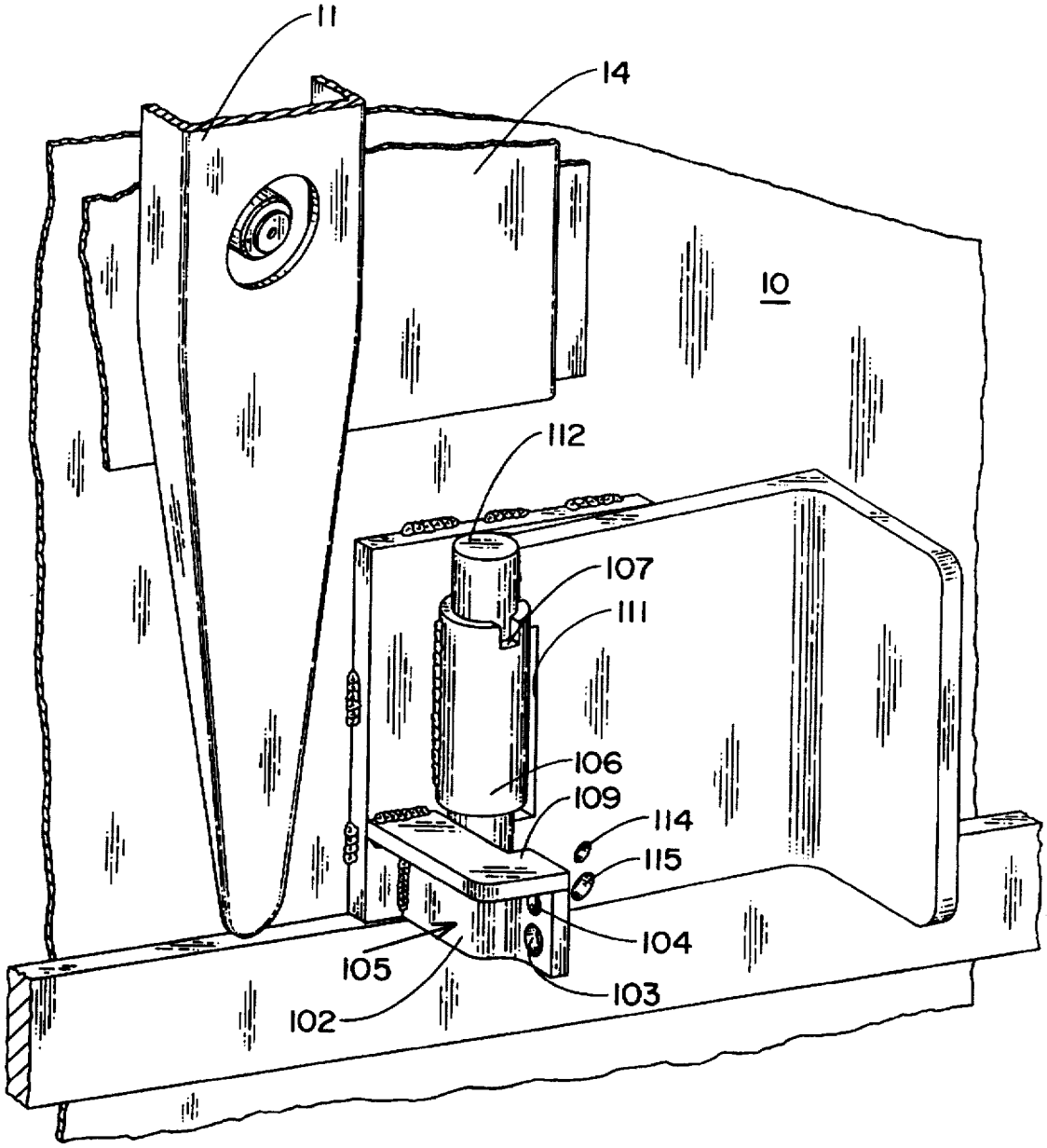
FIG. 2 is a perspective view of the locking device of FIG. 1 with the device held in a position out of interference with the rotational movement of the rotatable handle, thereby permitting the rotation thereof to move the loading door for access into the freight car.

Referring now to the first embodiment as shown in FIGS. 1–5, FIG. 1 illustrates a locking device 100 secured to the sliding freight door 10 of a railroad freight or box car. As is known to those skilled in the art, the opening mechanism of the freight car door 10 is actuated through the rotational movement of a door handle 11, which permits the car door to be slid between open and closed positions. In FIG. 1, the locking device 100 is illustrated in a locked position which bars the door handle 11 from being rotated by fixing a swing lock portion 110 of the locking device in a position which interferes with such rotational movement, as illustrated. In FIG.2, the locking device is shown with the swing lock portion 110 positioned out from interference with the rotational movement of the door handle 11, thereby permitting the door handle to be rotated for opening and closing the door 10.

Figure 3:
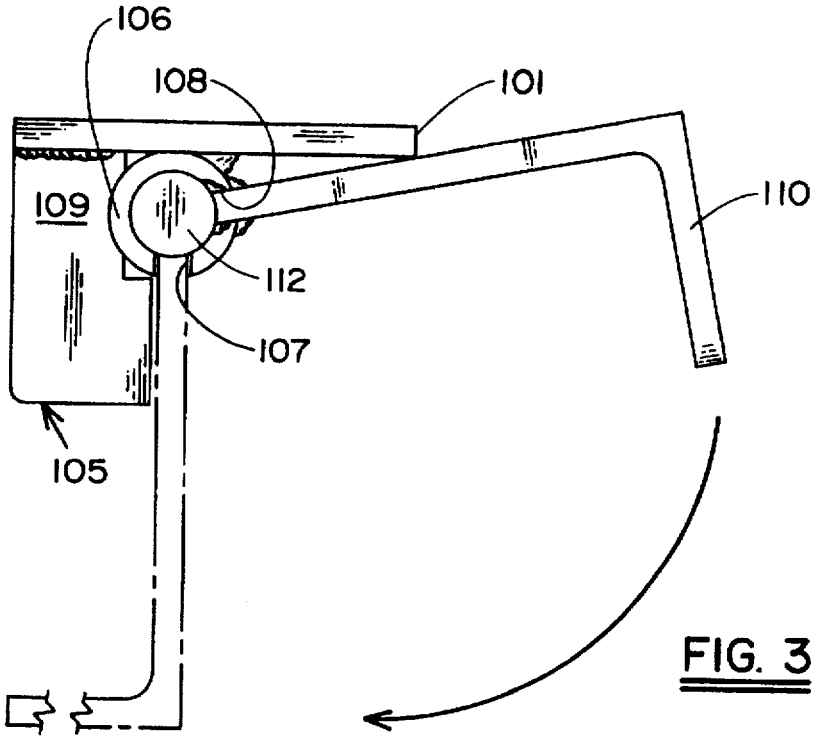
FIG. 3 is a top elevational view of the invention showing the locking device positioned out of interference with the rotational movement of the rotatable door handle, with phantom lines showing the device when in the securing position.
Figure 4:
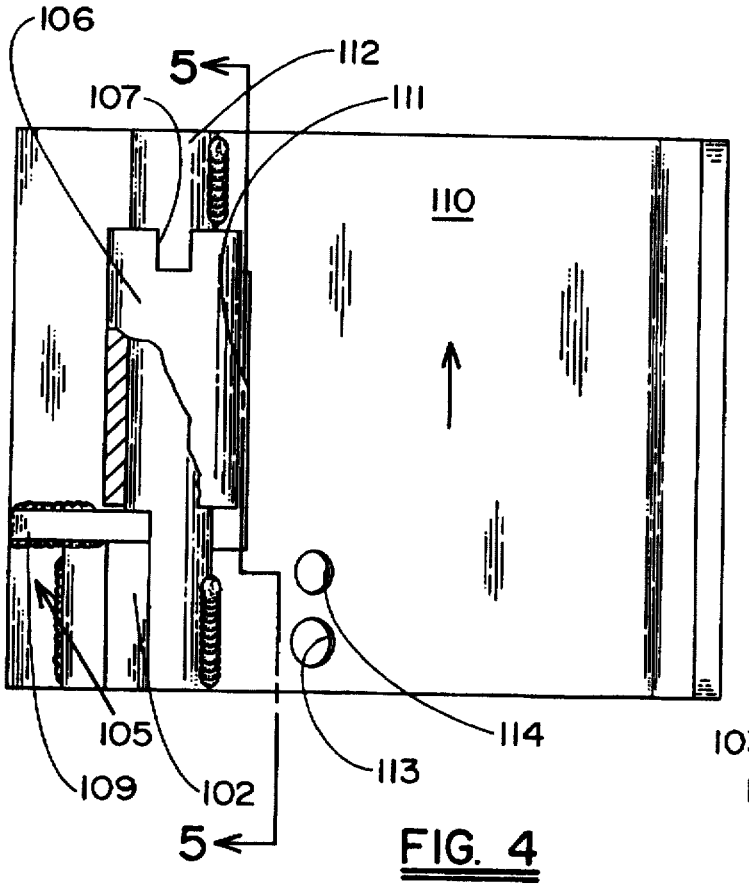
FIG. 4 is a front elevational view of the invention shown in FIG. 3 with portions broken away to better illustrate the structure thereof.
Figure 5:
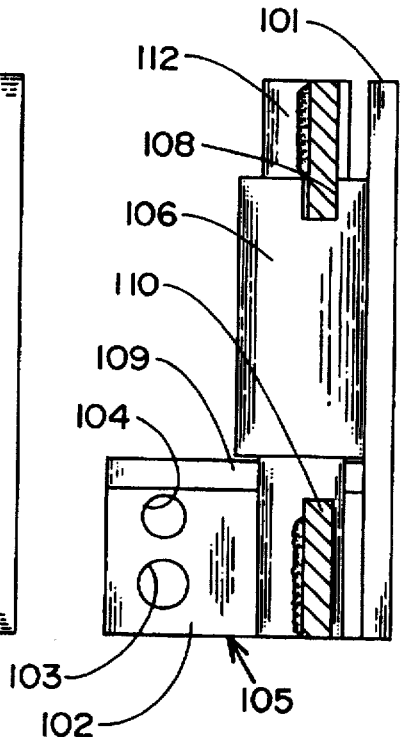
FIG. 5 is a sectional view of the invention illustrated in FIG. 4 taken along lines 5—5.
Figure 6:
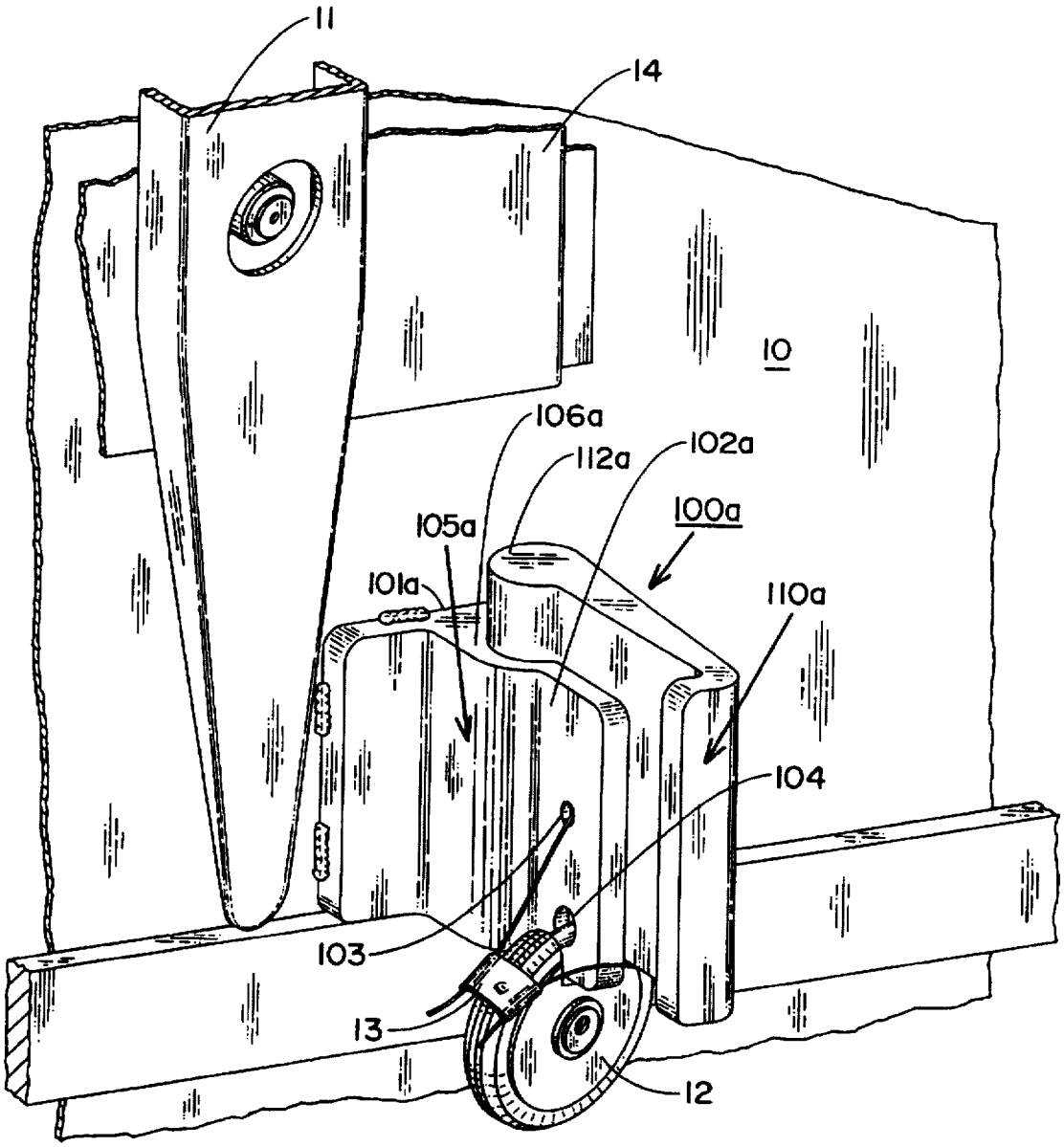
FIG. 6 is a perspective view of an alternative embodiment of the locking device of this invention incorporated into the structure of a freight car loading door and locked in a position to prevent rotation of the door handle.
Figure 7:
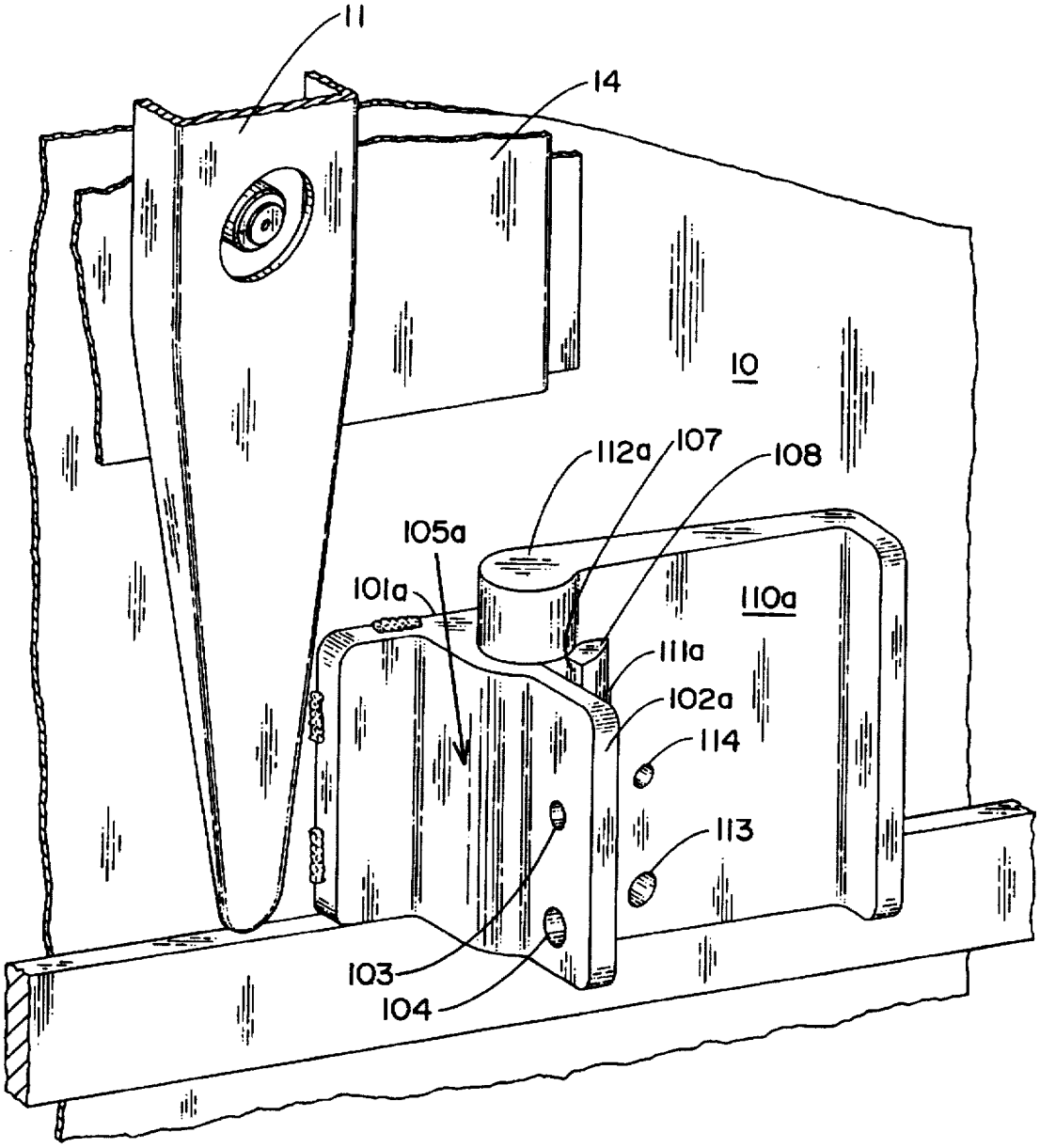
FIG. 7 is a perspective view of the alternative embodiment of the locking device of FIG. 6 with the device held in a position out of interference with the rotational movement of the rotatable door handle.
Figure 8:
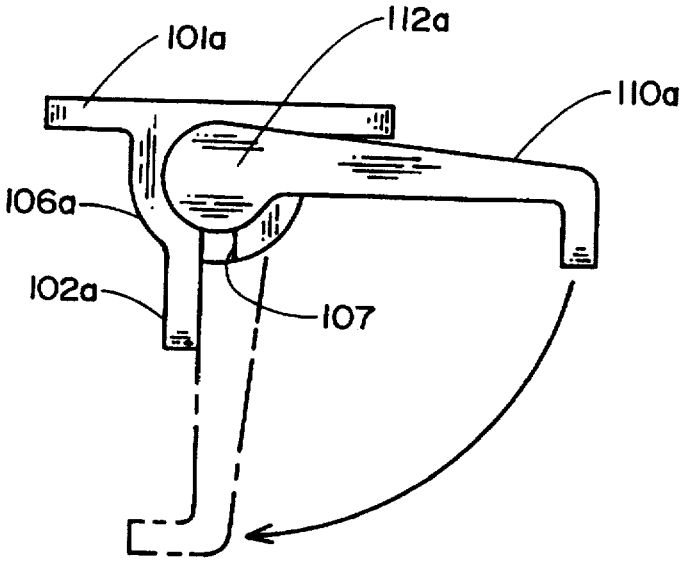
FIG. 8 is a top elevational view of the alternative embodiment of the invention showing the locking device positioned out of interference with the rotational movement of the rotatable door handle, with phantom lines showing the device when in the securing position.
Figure 9:
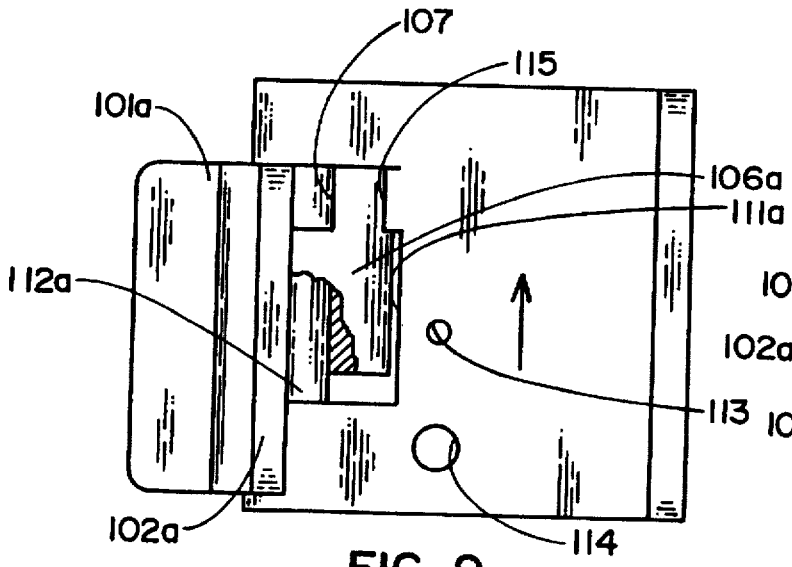
FIG. 9 is a front elevational view of the invention shown in FIG. 8 with portions broken away to better illustrate the structure thereof.
Figure 10:
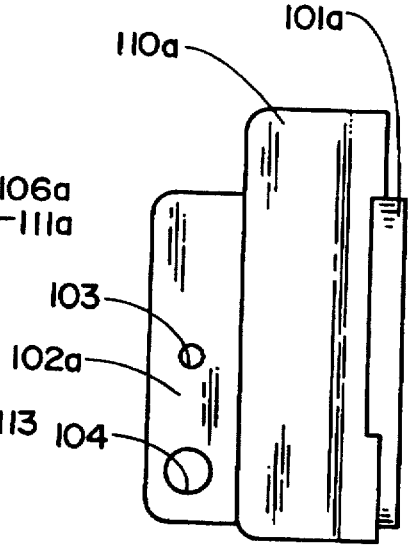
FIG. 10 is a side elevational view of the invention shown in FIGS. 8 and 9.
Figure 11:
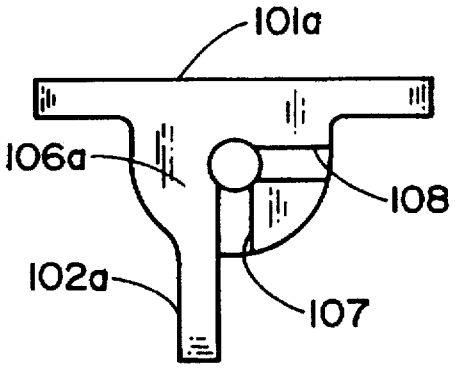
FIG. 11 is a top elevational view of the portion of the locking device which is secured to the box car door, to better illustrate the manner in which the lock in held in either an open or closed position.
Figure 12:
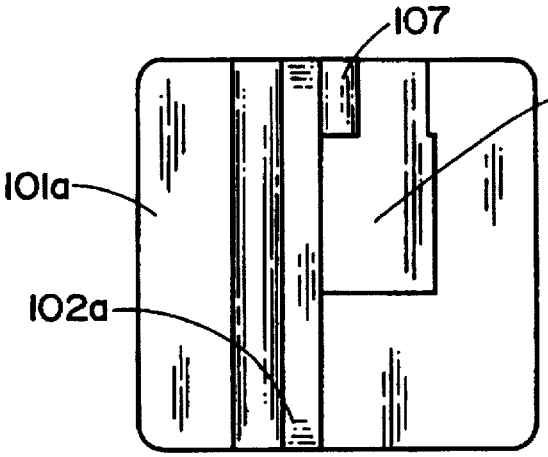
FIG. 12 is a front elevational view of the securing portion of the locking device shown in FIG. 11.
Figure 13:
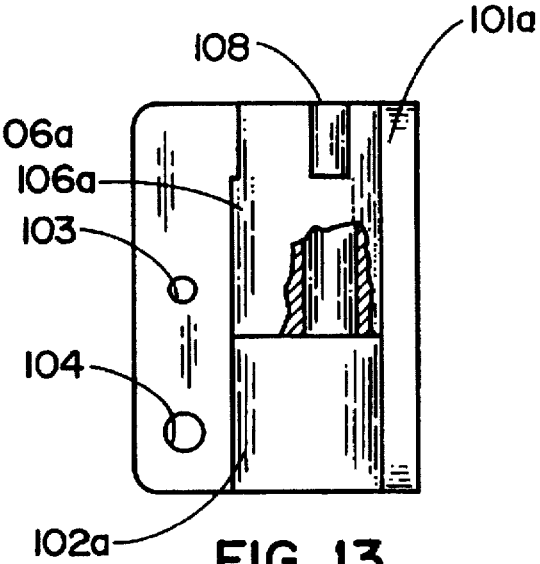
FIG. 13 is a side elevational view of the portion of the locking device shown in FIGS. 11 and 12 with portions broken away to better illustrate the structure thereof.
Figure 14:
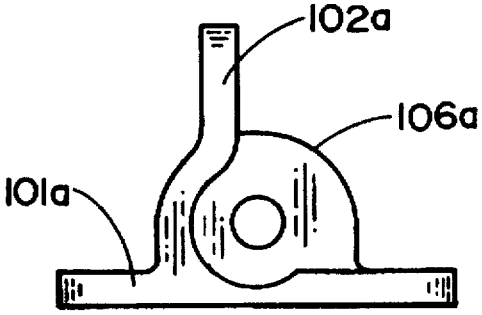
FIG. 14 is a bottom view of the portion of the locking device illustrated in FIGS. 11, 12 and 13.
Figure 15:
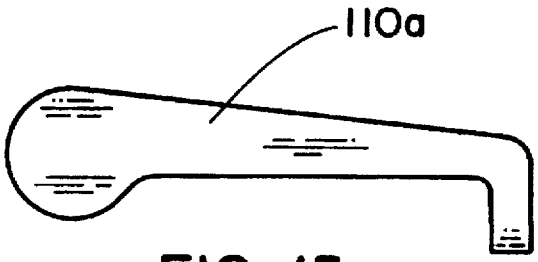
FIG. 15 is a top elevational view of the swing lock portion of the locking device that pivots relative to the securing portion for locking the box car door handle.
Figure 17:
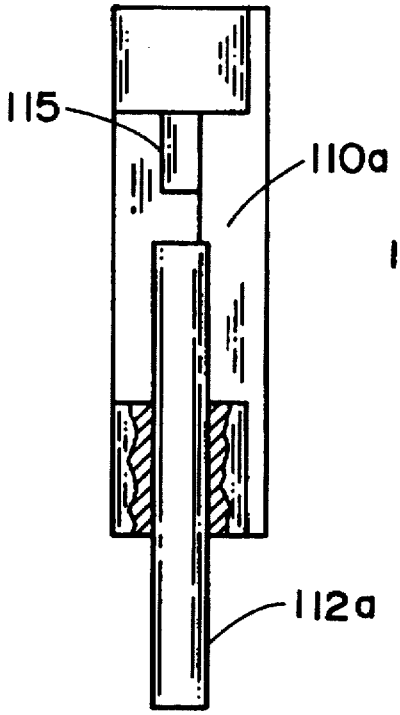
FIG. 17 is a side elevational view of the swing lock portion with the pivot pin partially projecting through the bight of the swing lock portion.
Figure 16:
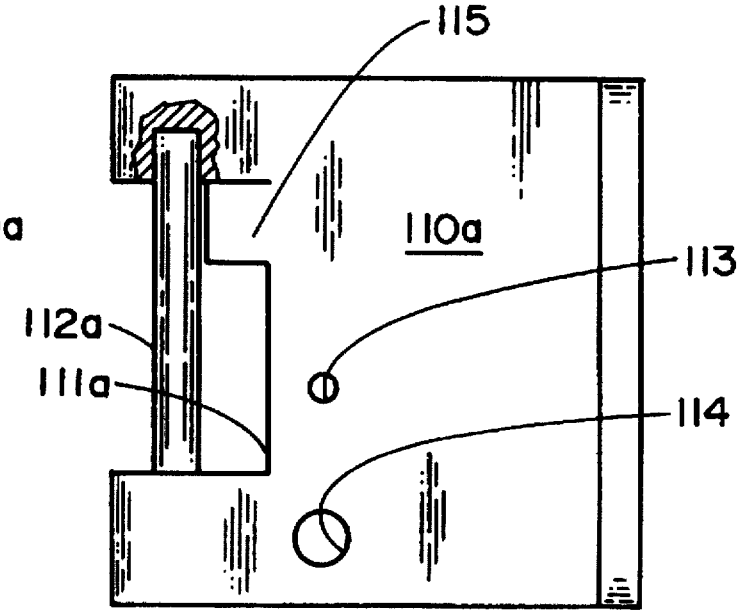
FIG. 16 is a frontal elevational view of the swing lock portion, with a portion broken away, as shown in FIG. 15.
Figure 18:
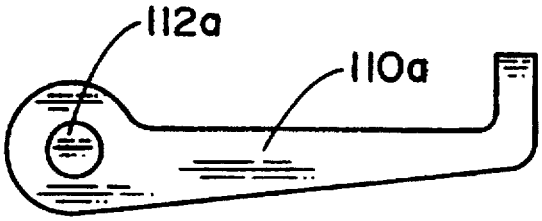
FIG. 18 is a bottom elevational view of the swing lock portion.

Referring now to FIGS. 3–5, the locking device 100 is secured to the door 10 of a railroad freight or box car as by, for example, welding a base plate 101 of a securing portion 105 to the car door. The base plate 101 must be welded to the door 10 at a position whereby the swing lock portion or plate 110, pivotally attached thereto, will be out of interference with rotational movement of the door handle 11 when held in the unlocked position illustrated in FIG. 2, but upon pivotal movement to a position perpendicular to the base plate 101, the locked position, the swing lock portion 110 will interfere with such rotational movement as shown in FIG. 1. In addition, the base plate 101 must be spaced from the gear box 14 of the freight car door opening mechanism a sufficient distance to permit the swing lock plate 110 to be raised for effecting movement between the locked and unlocked positions in a manner to be discussed hereinafter in more detail.

The securing portion 105 includes a lock plate 102, and a pivot bushing 106, each secured to the base plate 101 as by, for example, welding. The lock plate 102 extends outwardly substantially perpendicular to the base plate 101, and at the distal end thereof has a pair of holes 103 and 104 formed therein. These holes are positioned to be in alignment with similar holes 113 and 114 formed in the swing lock plate 110 when the swing lock is in the locked position to prevent rotational movement of the freight car door handle 11. In this embodiment the lowermost holes 103,113 are larger than the uppermost holes 104,114, and are the opening through which the hasp of a padlock 12 is passed when securing the swing lock plate 110 in a fixed position against the lock plate 102 to prevent rotational movement of the door handle 11. The holes 103,113,104 and 114 could be, however, the same size. The uppermost holes 104,114 are provided to receive a standard door seal 13. Such door seals 13 do not, and are not intended to, prevent the opening of the freight car door 10, but function to show that the door has been opened even if the opening was authorized.

A protector plate 109 is secured to the base plate 101 and the lock plate 102, as by welding, and extends outwardly from the base plate 101 substantially perpendicular thereto and perpendicular to the lock plate 102. The protector plate 109 functions to protect the hasp of the padlock 12 from being readily accessible to the blade of a hacksaw or the jaws of a bolt cutter, and like the lock plate 102 can not extend outwardly from the base plate 101 into interference with rotational movement of the door handle 11.

As best illustrated in FIGS. 2, 4 and 5, the pivot bushing 106 is formed with a pair of notches 107 and 108 in which the swing lock portion 110 is engaged when in the locked (107) and unlocked (108) position, respectively. To this end the swing lock portion 110 is formed with a longitudinally extending opening 111, adjacent to and spaced from a pivot rod 112, to which the lock portion is secured as by welding. As shown, the opening 111 is formed of a depth exceeding the thickness of the pivot bushing 106 and extends a length exceeding the length of the pivot bushing. In this manner the swing lock portion 110 can be raised and pivoted about the pivot bushing 106 into a position to be placed in either of the notch openings 107 or 108 depending upon whether or not the door 10 is to be locked against opening or is to freely operate. When the swing lock portion 110 is positioned in notch opening 108, the swing lock is held in a position out of the way to prevent unintentional interference with the operation of the freight car door 10, and to minimize a potential hazard in the event the swing lock plate 110 was to freely swing about its pivot. When the swing lock 110 is positioned in notch opening 107, it is adjacent to the lock plate 102 and protector plate 109, in a position for securing the freight car door against unauthorized entry.

Referring now to the embodiment illustrated in FIGS. 6–18, parts similar to the first embodiment are indicated by the same reference numeral, and those parts which perform the same function but with a varying structure are indicated by the same number with a subscript.

In this embodiment, the base plate 101*a* and lock plate 102*a* are formed as one piece, with holes 103 and 104 formed therein. Corresponding holes 113 and 114 are formed in the swing lock plate 110*a*, positioned in alignment for receiving the hasp of a padlock 12 or a door seal 13, respectively. The pivot pin bushing 106*a*, about which the swing lock 110*a* pivots between a locked position and an open or unlocked position, is formed with a pair of notches 107 and 108. These notches, respectively, function to receive a tab 115 of the swing lock plate 110*a* to hold the swing lock in either of these positions. Pivotal movement of the swing lock plate 110*a* is effected by a pivot pin or rod 112*a* secured in a bifurcated end of the swing lock plate 110*a*. The size of the opening 111*a* extending between the tab 115 and the opposed bifurcated portion is such that the swing lock plate 110*a* can be raised to release the tab 115 from the notches 107 or 108 to move the swing lock 110*a* between the locked or unlocked positions. As with the first embodiment illustrated in FIGS. 1–5, the lock plate 102*a* can not extend perpendicularly outwardly from the base plate 101*a* a distance which will interfere with the rotational movement of the freight car door handle 11.

While this invention has been described and explained with reference to preferred embodiments, the structures of which have been disclosed herein, it will be understood by those skilled in the art to which this invention pertains that various changes may be made and equivalents may be substituted for elements thereof without departing from the invention. In addition, many other modifications may be made to adapt this invention to a particular application. Therefore, it is intended that the invention not be limited to the particular embodiments disclosed in the specification and illustrated in the drawings as the best mode presently known by the inventor for carrying out the invention, nor confined to the details set forth, but that the invention will include all embodiments, modifications and changes as come within the scope of the following claims:

What is claimed is:

1. A locking device for preventing the rotation of a rotatable handle, the rotation of which controls entry into an enclosure, comprising:

a base plate adapted to be secured to a door upon which a rotatable handle is positioned, the rotation of the rotatable handle controlling entry into an enclosure, a bushing, having a length and a thickness, secured to said base plate and having a first locked notch opening formed therein at a position opposed to said base plate and extending substantially normal thereto, and a second unlocked notch opening formed therein at a position between said first locked notch opening and said base plate for receiving and retaining a swing lock plate positionable into and out from interference with the rotational movement of the rotatable handle in accordance with the respective positioning of the swing lock plate into said first locked or second unlocked notch opening, a swing lock plate having a pivot pin secured to one end thereof and extending into said bushing for forming a pivot connection thereto, said swing lock plate extending a distance outwardly from said pivot pin and having an opening formed therein adjacent to said pivot pin, said swing lock plate opening having a length exceeding the length of said bushing and having a depth exceeding the thickness of said bushing to permit pivotal movement of said swing lock plate between said first locked notch and said second unlocked notch openings, said pivot pin having a longitudinal axis, and said swing lock plate extending outwardly therefrom in a plane parallel to the longitudinal axis of said pivot pin and normal to said base plate a distance sufficient to engage the rotatable handle when said swing lock plate is positioned in said first locked notch opening of said bushing, a securing member extending outwardly from said base plate to a position adjacent to said swing lock plate when said swing lock plate is positioned into said first locked notch opening, said securing member including a lock plate secured to said base plate adjacent to said bushing and extending outwardly substantially normal to said base plate a distance less than the outwardly extending distance of said swing lock plate, said lock plate having an end thereof extending parallel to said swing lock plate when said swing lock plate is positioned into said first locked notch opening, said securing member and said swing lock plate each having formed therein a lock receiving opening, said lock receiving openings being coaxially aligned each with the other for receiving therethrough a removable lock for locking said securing member and said swing lock plate together to prevent rotational movement of the rotatable handle.

2. The locking device of claim 1 wherein said securing member includes a protector plate extending outwardly from said base plate to a position adjacent to said lock receiving openings formed in said securing member and said swing lock plate to protect the hasp of a removable lock when positioned in said openings to prevent rotational movement of the rotatable handle.

3. The locking device of claim 1 wherein said securing member and said swing lock plate each include a coaxially aligned door seal receiving opening formed therein at a position adjacent to said lock receiving opening for passing a seal therethrough to provide a display for showing when the door has been opened.

4. The locking device of claim 1 wherein said swing lock plate is substantially L-shaped in horizontal cross section with a distal end portion thereof extending substantially parallel to said base plate for protecting the hasp of a removable lock when positioned in the lock receiving openings formed therein.

5. The locking device of claim 1 wherein said swing lock plate includes a tab member for engaging said first locked notch opening and said second unlocked notch opening to retain said swing lock plate, respectively, into and out from interference with the rotational movement of the rotatable handle controlling entry into the enclosure.

6. A sliding loading door with a locking device for preventing entry into a railroad freight car, the entry into which is controlled by rotation of a rotatable handle mounted on the loading door, comprising:

a base plate secured to said sliding loading door, said sliding loading door having a rotatable handle secured to said door, the rotation of said handle controlling entry into a railroad freight car, a bushing, having a length and a thickness, secured to said base plate and having a first locked notch opening formed therein at a position opposed to said base plate and extending substantially normal thereto, and a second unlocked notch opening formed therein at a position between said first locked notch opening and said base plate for receiving and retaining a swing lock plate positionable into and out from interference with the rotational movement of the rotatable handle in accordance with the respective positioning of the swing lock plate into said first locked or second unlocked notch opening, a swing lock plate having a pivot pin secured to one end thereof and extending into said bushing for forming a pivot connection thereto, said swing lock plate extending a distance outwardly from said pivot pin and having an opening formed therein adjacent to said pivot pin, said swing lock plate opening having a length exceeding the length of said bushing and having a depth exceeding the thickness of said bushing to permit pivotal movement of said swing lock plate between said first locked notch and said second unlocked notch openings, said pivot pin having a longitudinal axis, and said swing lock plate extending outwardly therefrom in a plane parallel to the longitudinal axis of said pivot pin and normal to said base plate a distance sufficient to engage the rotatable handle when said swing lock plate is positioned in said first locked notch opening of said bushing, a securing member extending outwardly from said base plate to a position adjacent to said swing lock plate when said swing lock plate is positioned into said first locked notch opening, said securing member including a lock plate secured to said base plate adjacent to said bushing and extending outwardly substantially normal to said base plate a distance less than the outwardly extending distance of said swing lock plate, said lock plate having an end thereof extending parallel to said swing lock plate when said swing lock plate is positioned into said first locked notch opening, said securing member and said swing lock plate each having formed therein a lock receiving opening, said lock receiving openings being coaxially aligned each with the other for receiving therethrough a removable lock for locking said securing member and said swing lock plate together to prevent rotational movement of said rotatable handle and thereby entrance into the freight car.

7. The locking device of claim 6 wherein said securing member includes a protector plate extending outwardly from said base plate to a position adjacent to said lock receiving openings formed in said securing member and said swing lock plate to protect the hasp of a removable lock when positioned in said lock receiving openings to prevent rotational movement of the rotatable handle.

8. The locking device of claim 6 wherein said securing member and said swing lock plate each include a coaxially aligned door seal receiving opening formed therein at a position adjacent to said respective lock receiving openings for passing a seal therethrough to provide a display for showing when said door has been opened.

9. The locking device of claim 6 wherein said swing lock plate is substantially L-shaped in horizontal cross section with a distal end portion thereof extending substantially parallel to said base plate for protecting the hasp of a removable lock when positioned in the lock receiving openings formed therein.

10. The locking device of claim 6 wherein said swing lock plate includes a tab member for engaging said first locked notch opening and said second unlocked notch opening to retain said swing lock plate, respectively, into and out from interference with the rotational movement of said rotatable handle, the operation of which controls entry into the freight car.

* * * * *